United States Patent [19]

Hansen, III et al.

[11] Patent Number: 4,647,740

[45] Date of Patent: Mar. 3, 1987

[54] FLOAT SWITCH ASSEMBLY FOR REFRIGERATION SYSTEM

[75] Inventors: Charles C. Hansen, III, Hinsdale; John A. Yencho, Elmhurst, both of Ill.

[73] Assignee: Hansen Technologies Corp., Downers Grove, Ill.

[21] Appl. No.: 695,278

[22] Filed: Jan. 28, 1985

[51] Int. Cl.[4] ..... H01H 35/18

[52] U.S. Cl. ..... 200/84 C; 340/624

[58] Field of Search ..... 340/623, 624 X; 73/308, 73/311, 313 X, 319, 322, 322.5; 200/84 R, 84 C, 820; 219/209

[56] References Cited

U.S. PATENT DOCUMENTS

| | | | |
|---|---|---|---|
| 2,588,761 | 3/1952 | Raby | 340/624 |
| 2,660,656 | 11/1953 | Wilkie | 219/209 |
| 2,736,013 | 2/1956 | Bimford | 73/311 |
| 2,782,272 | 2/1957 | Cornelius | 200/82 C |
| 3,402,280 | 9/1968 | Grigg | 219/209 |
| 3,632,465 | 1/1972 | Guth | 219/209 |
| 4,404,441 | 9/1983 | MacLaren | 200/84 C |

OTHER PUBLICATIONS

Refrigerant Float Switch Application Manual–Copyright, 1976.

Bulletin–61–10C–Float Switch–Parker Hannifin Corp., Jul., 1980.

*Primary Examiner*—G. P. Tolin

*Attorney, Agent, or Firm*—James N. Videbeck

[57] ABSTRACT

An improved refrigerant float switch assembly includes a float chamber adapted for mounting in fluid communication with a refrigeration system, and a proximity switch assembly mounted adjacent the float chamber and having a tubular extension of the float chamber positioned therein. Improvements in the float chamber include the use of a baffle adjacent and inlet port thereof, and a float impact damper positioned inwardly adjacent the connection between the float chamber and tubular extension thereof. Improvements in the proximity switch portion of the refrigerant float switch assembly include a switch mechanism having an activating arm mounted directly thereon with the actuation of the switch being positioned internally of the assembly between the switch housing and the actuation arm therefore. In a second embodiment of the invention, a plurality of proximity switches are mounted on the switch assembly in spaced relation along the tubular extension of the float chamber.

12 Claims, 10 Drawing Figures

FLOAT SWITCH ASSEMBLY FOR REFRIGERATION SYSTEM

BACKGROUND OF THE INVENTION

This invention relates generally to improvements in refrigerant float switch assemblies and more particularly, to improvements in the refrigerant float chamber, to the float, and to the electrical proximity switching mechanism used to sense change in the float level and open or close an electrical circuit when a pre-determined float level is obtained.

Heretofore, known electrical switching mechanisms for refrigerant float switches have utilized miniature electrical switches in combination with an externally mounted pivotal arm having a magnet positioned adjacent a distal end thereof. In operation, an elongate stem extending from the top of a float moves in proximity with the magnet, and movement of the magnet toward the rod acts through an external linkage attached to both the arm and switch to actuate the electrical switch. Further, heretofore known electrical switch assemblies have been limited to one such switch per float assembly. Known floats have utilized a solid rod type stem mounted at the top of the float so as to extend into a non-magnetic sealed tube positioned above the float chamber in fluid communication with it. A switch housing having the electrical switch assembly mounted thereon is positioned over and around the sealed tube for actuation by movement of the rod in proximity therewith. The weight of previously used solid stems has slowed reciprocal operative movement of the float.

Additionally, surges of refrigerant into a float chamber may impart an upward velocity of 10 to 20 feet per second to the float which has heretofore been abruptly stopped when the float strikes the top of the float chamber. This results in repetitive shear stress occurring between the float, the stem, and the small stop at the top of the float chamber which shortens the operating life of the float.

A need has developed for improvements in refrigerant float switch assemblies which yield longer operating life, greater reliability, and quicker response, and less wear and tear on parts of the assembly.

SUMMARY OF THE INVENTION

The invention is directed in an electrical switch mechanism for use in a refrigerant float switch of the type having a base, an arm pivotally mounted with respect to the base, with a magnet mounted adjacent a first distal end portion of the arm for attraction to a float when the float is positioned in proximity to the magnet. A switch arm is mounted operatively in connection with the switch mechanism. The invention is directed to an improvement wherein the electrical switch mechanism is mounted on the base and the arm is pivotally mounted on the switch mechanism. The second portion of the arm, opposite the pivotal mounting from the magnet, directly operates a switch actuation member positioned internally of the combination switch mechanism and the arm mounted thereon.

The invention is further directed in a float switch for use in connection with a refrigeration system. The switch being of the type having a refrigerant chamber adapted for fluid communication with a refrigeration system, an elongate non-magnetic generally tubular member extending from the top of the refrigerant chamber in fluid communication therewith, float means reciprocally moveable in the refrigerant chamber, the float means including a float and an elongate stem extending from the float into a hollow center of the tubular member for reciprocal movement therein. The invention is directed to an improvement wherein the elongate stem is tubular in construction.

BRIEF DESCRIPTION OF THE DRAWINGS

The features of the present invention which are believed to be novel are set forth with particularity in the appended claims. The invention, together with further objects and advantages thereof, may be best understood by reference to the following description taken in conjunction with the accompanying drawings, wherein like reference numerals identify like elements throughout, and in which:

DETAILED DESCRIPTION OF THE PREFERRED EMBODIMENTS

Figure 1:
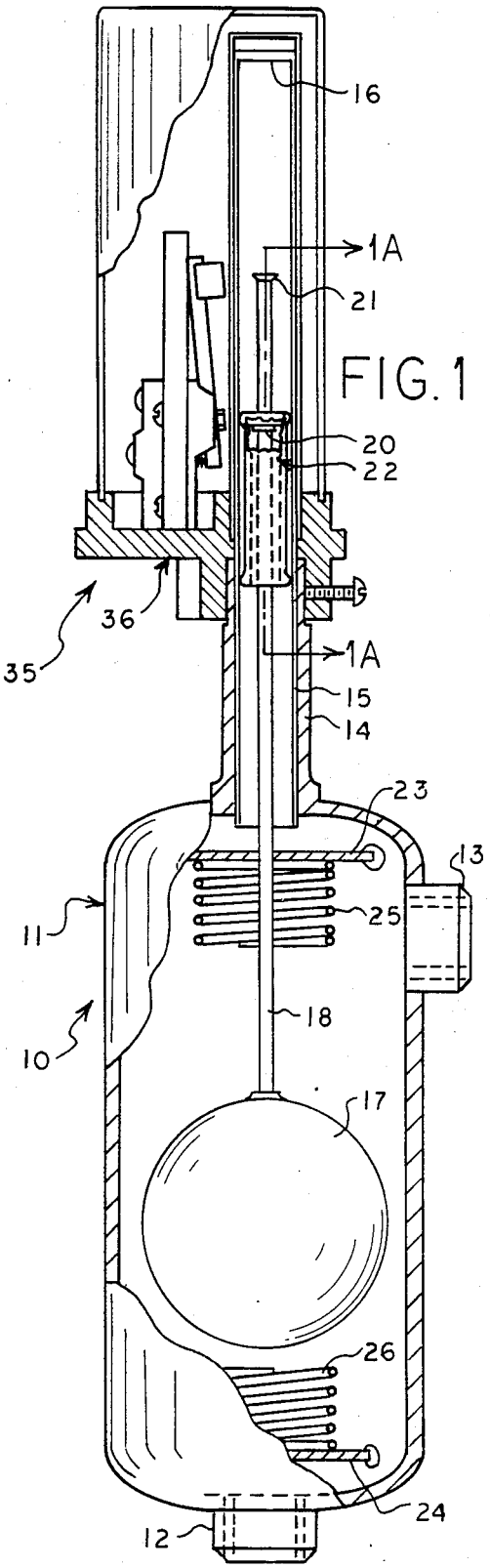
FIG. 1 is a vertical elevational view, with portions cut away, of a refrigerant float valve assembly constructed in accordance with the present invention.
Figure 1B:
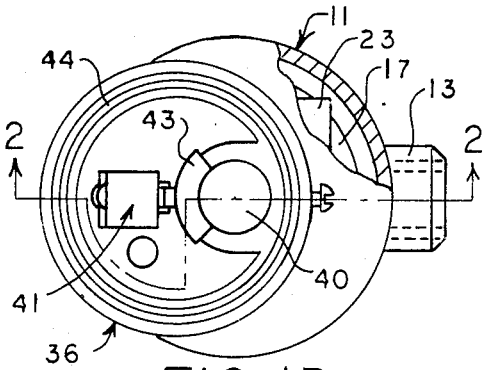
FIG. 1B is a horizontal plan view of the refrigerant float valve assembly shown in FIG. 1.

Referring to FIGS. 1 and 1B, a refrigerant float switch, generally indicated at 10, includes a float chamber 11 which is generally mounted along side a reservoir (not shown) for a refrigeration system, and is mounted in fluid communication with that reservoir, such communication being accomplished between an inlet duct 12 and an outlet duct 13 of the float chamber. A generally tubular float chamber extension 14 protrudes vertically from the top of float chamber 11 in fluid communication therewith, extension 14 includes an inner vertical sleeve 15 which extends substantially upwardly vertically therefrom to a closed top end 16.

Inside the hollow interior of float chamber 11 is mounted a float ball 17 having an elongate tubular stem 18 which extends vertically from float ball 17 upwardly into the hollow interior of float chamber extension 14 and sleeve 15. In the first embodiment of the present invention tubular stem 18 is made of non-magnetic material such as stainless steel. Tubular stem 18 includes a stop or annular flange 20 positioned spacially subjacent the upper distal flared end 21 thereof. An attractor 22 is loosely slidably retained on stem 18 with an upper semi-closed end of the attractor retained between the flared upper distal end 21 and the annular flange 20 on stem 18.

Inwardly adjacent the top and bottom of the float chamber 11, are mounted baffle plates 23, 24, respectively, with each having a coil spring 25, 26, respectively, retained centrally thereon for absorbing energy imparted by any rapid reciprocal movement of the float ball 17. The rate of speed at which the float ball moves to the top of the chamber is faster than one would expect. This is due to the volatile nature of the refrigerant liquid. The cold liquid is at saturation, a condition where the temperature and pressures are such that there is equilibrum between a liquid state and a gaseous state. A sudden drop of pressure changes liquid to gas creating a boiling liquid below the float ball. The gas velocity generated by the change in state quickly accelerates the ball upward to the top of the float chamber 11. Baffle plate 24 also acts as a surge dissipator for any refrigerant rapidly entering the float chamber. The combination baffle plate and coil spring acts to preserve the integrity and operating life of the float ball 17, and particularly protects the joinder between the float ball 17 and stem 18 and lengthen the potential life of the float valve assembly in a manner not heretofore known or used.

Figure 1A:
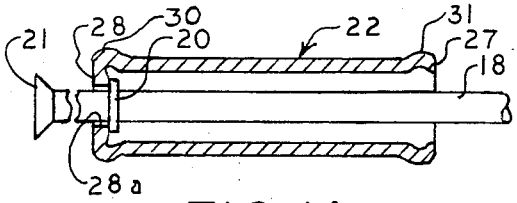
FIG. 1A is a cross-section view taken substantially along line 1A—1A,of FIG. 1.
Figure 3:
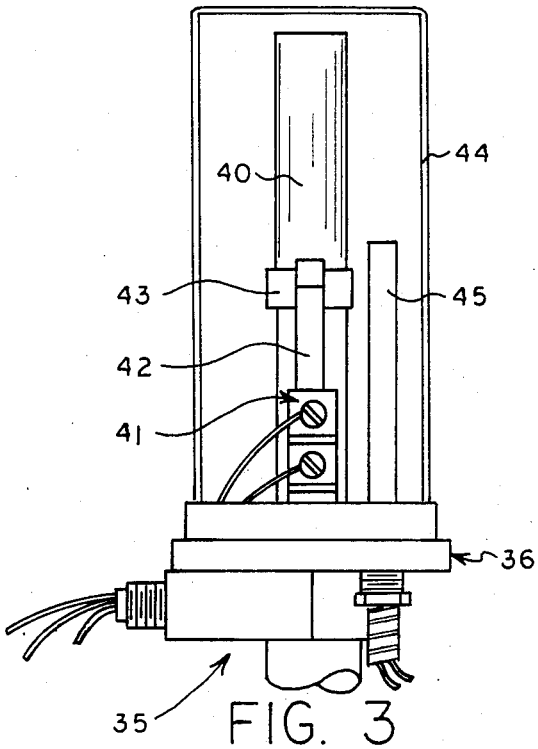
FIG. 3 is a detail left side elevational view of the electrical switch mechanism and housing therefore showing a cartridge heater mounted therein.

Referring to FIG. 1A, attractor 22 is an elongate tubular member having an open annular end 27, and substantially enclosed opposing end 28 having an aperture 28*a* centrally located therein which is sized to be slidably retained on stem 18 while being restrained in its movement relative the stem by the flared flange 21 at the distal upper end of stem 18, and by an annular flange or stop 20 positioned along the stem in this embodiment, approximately two inches below the flange top 21 of the stem 18. In this embodiment, the outside of attractor 22 is substantially cylindrical in shape with annular protrusions or rings 30, 31 respectively positioned adjacent each opposing end of the attractor. The rings 30, 31 are sized more closely to the diameter of sleeve 15 than the remainder of the elongate cylindrical body of attractor 22 in order to lessen the sliding contact or friction between the attractor 22 and sleeve 15 while providing a fairly close substantially rattle free sliding fit therebetween.

Referring to FIGS. 2, 2A, 2B and 3, an electrical switching assembly, generally indicated at 35, includes a base 36 which has an aperture 37 therethrough adapted for being fit closely over sleeve 15, and an annular mounting flange 38 subjacent aperture 37 which is adapted for being retained upon the top of float chamber extension 14. Above aperture 37 on base 35, an elongate tubular sheath 40 is adapted to closely fit over the sleeve 15 at the top of the float chamber 11. In the preferred embodiment, sleeve 15 and sheath 40 are made of non-magnetic material.

In one aspect of the present invention, an improved proximity switch, generally indicated at 41, is mounted on base 36. Proximity switch 41 includes a switch operating arm 42 pivotally mounted directly on the switch. At the upper distal end of operating arm 42, a U-shape magnet 43 is retained to be positioned in proximity to the nested tubes 15, 40 such that when the float ball 17 moves upwardly in float chamber 11, the magnetically attractive attractor 22 move upward into spacial proximity with the magnet 43 on operator arm 42, pivotally moving the arm and operating the switch. In the preferred embodiment, a closed generally hollow cylindrical cover 44, which may be transparent or opaque, is mounted on base 36 so as to extend thereabove and provide a protective nitrogen filled housing in which the proximity switch 41 is hermetically sealed. While the cover 44 could be made of glass or metal, a clear plastic material is less susceptible to breakage and provides for viewing the switch in operation.

With the base 36 being made out of non-magnetic material, preferably polycarbonate, and the cover 44 being made of a transparent plastic material, the term hermetic seal is only relatively construed and not an absolute. Present plastics all exhibit small amounts of permeability to water. In low temperature refrigerant systems, the difference in temperature between the inside and outside of the switch housing creates a vapor pressure balance great enough to condense water inside the housing. The unequal water vapor pressure will also drive moisture through the plastic over a period of time creating even more condensing of vapor to liquid. This can cause enough liquid to build up inside the housing to short circuit the switch. Applicant's switch includes a cartridge heater 45 which is mounted on the base in close spacial relation to switch 41, as shown most clearly in FIGS. 2B and 3. The cartridge heater prevents condensation by equalizing the vapor pressure inside and outside the switch cover 44.

Figure 2:
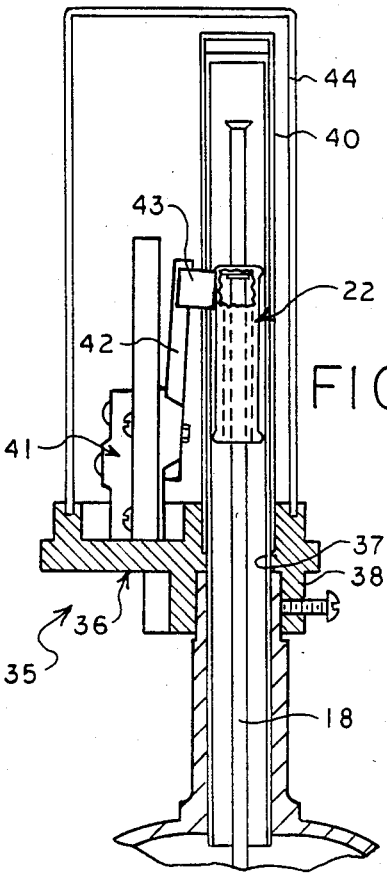
FIG. 2 is a detailed cross-section view taken substantially along line 2—2 of FIG. 1B, and similar to the top portion of FIG. 1 showing the float and stem adjacent its upward most position.
Figure 2B:
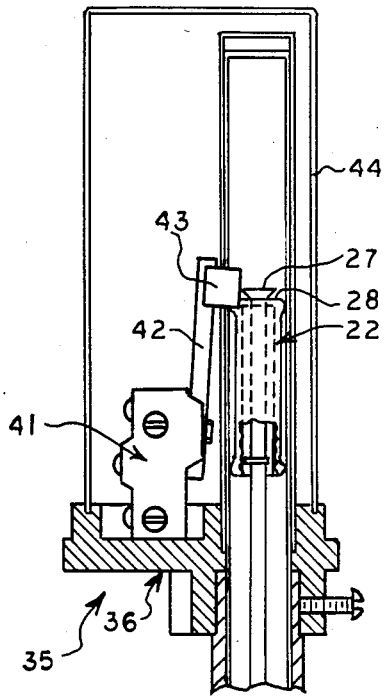
FIG. 2B is a detail cross-section similar to FIG. 2 showing the float stem in its lowermost switch attracting position.
Figure 2A:
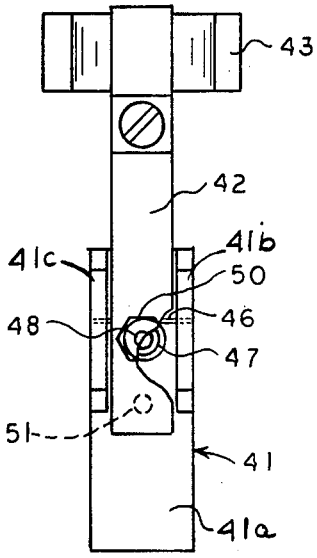
FIG. 2A is a detail right side detail elevational view of the electrical switch mechanism instructed in accordance with the present invention, with portions cut away showing the switch actuation member positioned between the operating arm and the switch body.

In one aspect of the present invention mentioned briefly previously, and shown most clearly in FIG. 2A, the operating arm 42 is directly pivotally mounted through pin 46 to detents 41B, 41C on one side 41A of the miniature electrical switch 41. Subjacent pin 46, a plunger or actuator 47 is reciprocally mounted in electrical switch 41 and, at its inner end (not shown) makes and/or breaks an electrical contact in the switch while its outer end extends slightly outwardly of one side 41A switch 41. An adjustable operating arm contact member 48, in this embodiment an allen head screw, is threadedly retained in operating arm 42 and locked in a desired position by a lock nut 50 to provide the precise amount of movement needed to operate changes in the switch mode. A coil spring 51 is positioned between switch 41 and operating arm 42 adjacent the bottom distal end of the arm to bias same. The entire switch 41 and operating arm 42 provide a compact integral switch mechanism wherein the moving parts of the switch are positioned in protected relation between the switch 41 and operating arm 42 to provide for long term reliable switching.

In operation, the refrigerant fluid level in chamber 11 would equal the fluid level in an adjacent reservoir and as that level would move up and down, float ball 17 and stem 18 would reciprocate in the respective chamber 11 and chamber extension sleeve 15. As the float ball ball moves upwardly in the sleeve as shown most clearly in the transition between FIGS. 1 and 2, the attractor 22 becomes positioned in proximity with magnet 43 as shown in FIG. 2 and pulls the magnet toward sheath 40 to change the conductive condition of switch 41. In order to stabilize the function of switch 41, and prevent switching flutter or other rapid on-off multiple operations of switch 41, a pre-determined amount of play is built into switch 41, in this embodiment, by means of approximately 2 inches of sliding movement between attractor 22 has just come into the proximity of magnet 43 with stem 18 being in a mediate vertical position. Stem 18 still has vertical travel available to it in FIG. 2, however, the float ball 17 (FIG. 1) will soon be stopped by spring 25. However, in FIG. 2B, stem 18 has moved downwardly and the magnetic attraction between attractor 22 and magnet 43 has caused the attractor 22 to remain in place and to slide relatively upwardly along stem 18 until the flanged upper end 21 of stem 18 comes in contact with upper wall 28 of attractor 22 and pulls the attractor downwardly and out of proximity with magnet 43. When magnet 43 is no longer in proximity to attractor 22, spring 51 biases the operating arm 42 such that the switch 41 operates to make or break contact as desired. At this time, the attractor 22 slides downwardly on stem 18 due to gravity until upper wall 28 is retained by annular flange 20 as shown in FIG. 1. If the float switch is placed near the bottom of the reservoir, as the float descends to an ominously low level, the switch 41 would operate to shut off equipment and/or turn on alarms, etc. when the refrigerant level became too low. If the float switch were used toward the top of the reservoir, the rise of the float ball and attractor would cause the switch to operate to shut off equipment and/or turn on alarms, etc. when the refrigerant level became too high. Other float switches may be used at intermediate levels for activities such as sounding warning alarms, operating to refill the reservoir with more refrigerant when the float level drops to a predetermined level, and the like. In the operation of a typical refrigeration system, several refrigerant float switches will be positioned at varying heights adjacent the reservoir. This has heretofore necessitated using a plurality of such refrigerant float switches.

In the second embodiment of the present invention, the benefit of combining the actuation arm and switch mechanism into a single unit are utilized to mount a second such switching mechanism, or a third, etc., at a predetermined position on the sheath in spacial relation above the first electrical switch mounted on the base of the switch housing.

Figure 6:
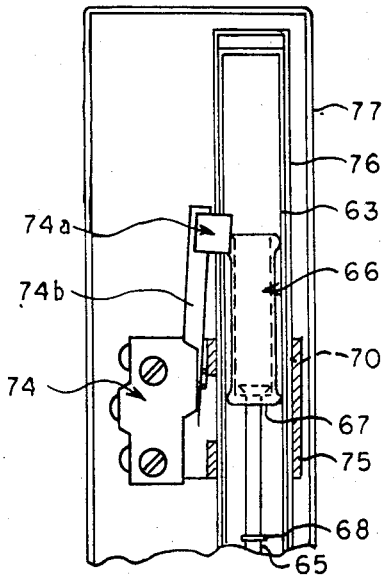
FIG. 6 is a detail cross-section view similar to the upper portion of FIG. 5 wherein the float stem has descended to its lowermost upper electrical switch attracting position.
Figure 4:
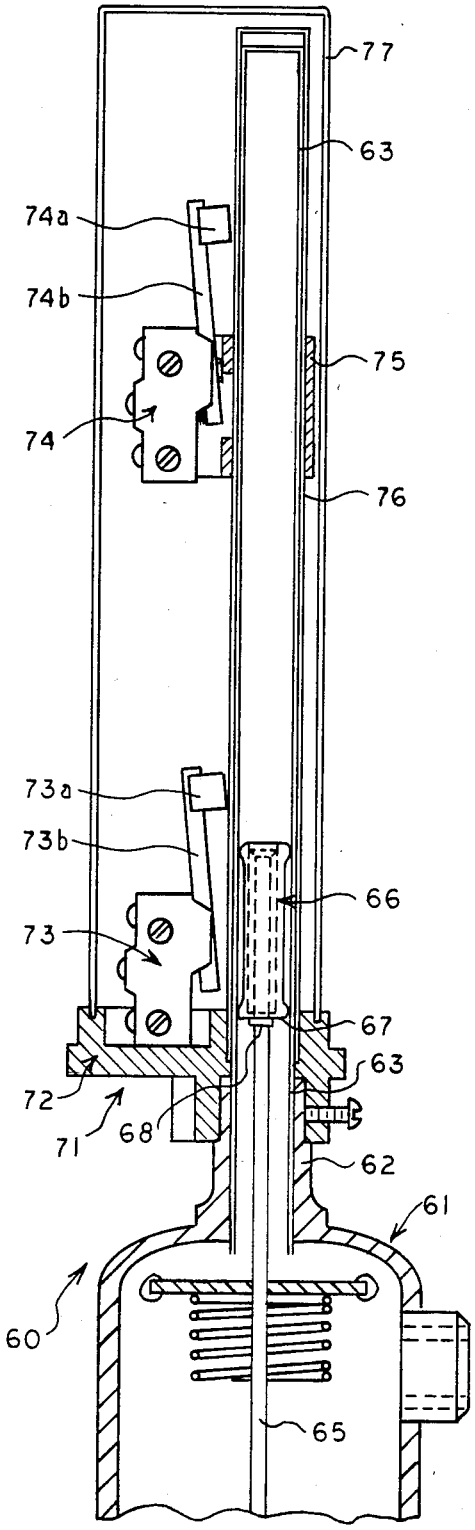
FIG. 4 is a detail cross-section view similar to FIG. 2 of a second embodiment of the present invention wherein two electrical switching mechanisms are mounted in spacial relation in a single switch housing.
Figure 5:
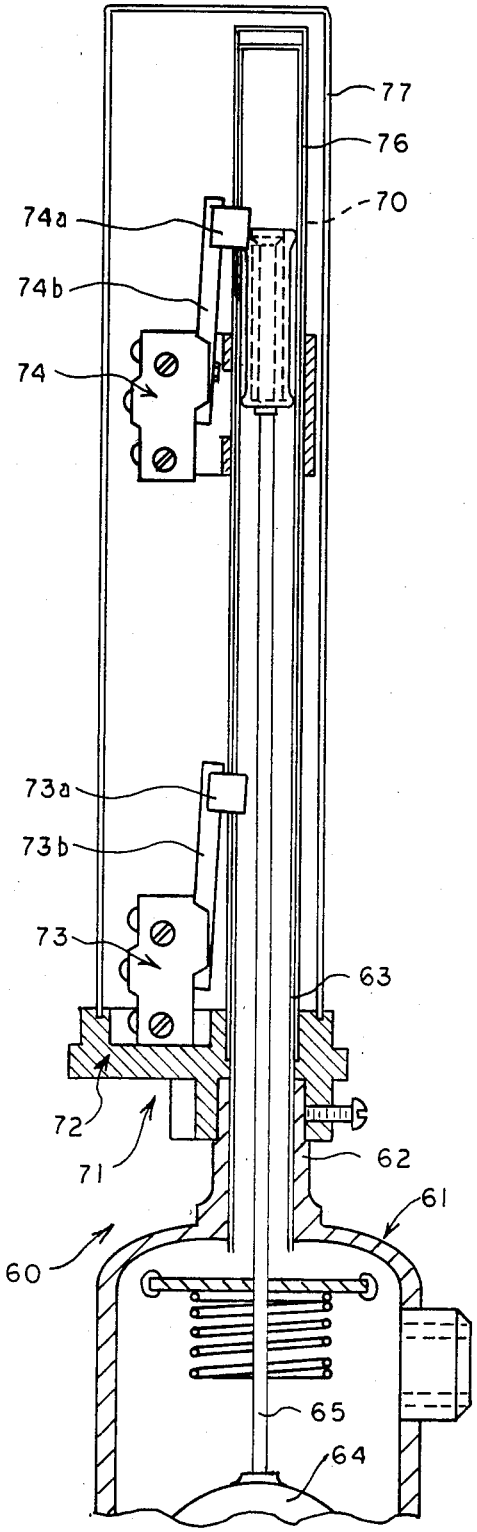
FIG. 5 is a detail cross-section view similar to FIG. 4 showing the float and stem for the dual-switch float assembly wherein the float and stem is an upper switch attracting position.

Referring to FIGS. 4, 5 and 6, a second embodiment of the refrigerant float switch of the invention generally indicated at 60 includes a float chamber 61 having a float chamber extension 62 protruding from the top thereof, and an extra long tubular sleeve 63 positioned inside chamber extension member 62 and extending substantially thereabove beyond the distance at which sleeve 15 extends above float chamber extension 14 in the first embodiment of the present invention. A float ball 64 is mounted in the float chamber 61 and includes an extra long stem 65 extending from the top thereof into the hollow interior of sleeve 63. In this second embodiment, stem 65 is made of magnetically attractable tubular material. An attractor 66 shaped similarly to attractor 22 in the first embodiment and made of magnetically attractive material, is mounted adjacent the distal upper end of stem 65 but in a position reversed from that of the mounting of attractor 22 on stem 18 in the first embodiment. Attractor 66 is mounted with its semi-closed end 67 positioned downwardly with respect to the stem 65 such that in the lowermost position of the attractor, bottom end 67 rests against annular flange 68 on stem 65, and in its uppermost position the semi-closed end 67 is retained on the stem 65 by contact with the flared upper end 70 thereof as shown most clearly in FIG. 6.

Referring to FIGS. 4 and 5, the electrical switch assembly, generally indicated at 71 includes a base 72 which is identical to base 36 of the first embodiment, a first proximity switch 73 mounted on base 72 which is identical to switch 41 of the first embodiment, and a second proximity 74 having a switch mechanism identical to switch 41, but having a mounting clamp 75 which secures switch 74 to an upper portion of an extra long sheath 76 mounted on base 72 so as to extend over sleeve 63. It should be noted that the sleeve 63 and sheath 76 are made of non-magnetic material, such as stainless steel to prevent interference between the magnet and the attractor. Clamp 75 may be a band-type clamp, a C-clamp having a bolt and nut extending across the open distal ends of the C, or any similar clamping mechanism which will removably retain the proximity switch 74 at the desired height on sheath 76. Additionally, clamp 75 may be made in the form of a sleeve which would fit over and be retained upon shroud 76 by adhesive means, welding, brazing or the like As in the first embodiment of the present invention, a transparent plastic cover 77 having an extra long length extends upwardly from base 72 to cover both the switching mechanisms and hermetically seal the cover to the base 72.

In operation, the two-level float switch of the second embodiment operates similarly to the single level float switch with certain exceptions. As the float ball 64 rises in the float chamber 61, the attractor 66 moves in proximity with the magnet **73*a* on operating arm 73*b* of switch 73 to operate the switch mechanism in lower switch 73. As the float ball continues to rise and attractor 66 moves above magnet 73*a*, the magnetically attractable material of stem 65 maintains the switch 73 in its thrown or actuated position as shown in FIG. 5. As the attractor 66 moves upwardly into proximity with the magnet 74*a* on operating arm 74*b* of switch 74, upper switch 74 is actuated as shown in FIG. 5**.

In order to provide for continuity of operation and to eliminate switch flutter, attractor 66 is slidably mountable on the distal end of stem 65 such that when the stem is lowered below magnet **74*a*, the magnet will maintain attractor 66 in proximity thereto until the flared end 70 on stem 65 pulls the attractor 66 away from magnet 74*a* which is the impending future action of that shown in FIG. 6. As stem 65 moves down below magnet 73*a* of lower switch 73 a similar slack of approximately 2 inches is provided by the attractor being reciprocally mounted on stem 65**. It should be noted that varying amounts of slack or slippage can be built into the unit. Slight changes may be made in the units to accommodate varying refrigerant liquids which may be used.

The use of a dual level switch in a refrigeration system previously requiring several single level switches, serves to reduce the total number of switches needed to control the liquid level in a refrigeration system. It will be understood that while a float control switch having two spacially related switches has been shown in the second embodiment of the present invention, such a multiple level float switching mechanism having more than two switches could easily be configured from the disclosure herein without undue experimentation. Thus, an improved refrigerant float switch assembly has been shown and described which provides for increased speed of switch operation, increased longevity of switch life and operation, and for eliminating a multiplicity of switches where one switch may be permitted to perform functions formerly performed by a multiple of switches.

While two embodiments of the present invention have been shown and described, it will be obvious to those skilled in the art that changes and modifications may be made without departing from the invention in its broader aspects. Therefore, the aim in the appended claims is to cover all such changes and modifications that fall within the true spirit and scope of the invention.

The invention is claimed as follows:

1. A refrigerant float switch assembly of the type having a float chamber, a base, a first proximity switch means mounted on said switch assembly, a switch operating arm pivotally mounted with respect to said base with a first means for magnetic attraction mounted on a first distal end portion of said arm, said first means in removable attraction to a complementary second means for magnetic attraction mounted on a float means reciprocably carried on said switch assembly, said arm being operatively mounted in connection with said proximity switch means, an improvement wherein said proximity switch means includes a body having first mounting means positioned on one side thereof for pivotally mounting said arm thereon, switch actuation means mounted on said one side of said body adjacent said first mounting means, said arm including a pivotal mounting thereon and a second portion of said arm opposite said pivotal mounting from said first means for magnetic attraction, said second portion of said arm directly operating said switch actuation means, said switch actuation means extending between said second portion of said arm and said one side of said switch means body wherein said float chamber includes biasing means mounted adjacent the top of said float chamber which cushions said float means as it approaches the top of said float chamber.

2. The refrigerant float switch assembly as defined in claim 1 wherein said second portion of said arm includes adjustment means thereon for use in contact with said switch actuation means.

3. The refrigerant float switch assembly as defined in claim 1 includes biasing means mounted between said arm and said proximity switch means body.

4. The refrigerant float switch assembly as defined in claim 1 wherein said base further includes a hollow dome member mounted thereon for enclosing and protecting said proximity switch means, and a heater mounted on said base and inside said hollow dome for preventing or lessening condensation inside said dome.

5. The refrigerant float switch assembly as defined in claim 1 wherein said base includes an elongate tubular member mounted thereon, said tubular member being closed above said base and open below said base for fluid communication with the remainder of a refrigerant float switch.

6. The refrigerant float switch assembly as defined in claim 5 further including a float chamber mounted below said base and adapted to be positioned in refrigerant communication with a refrigeration system, said float chamber including a float means therein adapted for reciprocal movement in said chamber, said float means including an elongate stem extending upwardly therefrom into said hollow tubular member.

7. The refrigerant float switch assembly as defined in claim 6 wherein said elongate stem is tubular.

8. The refrigerant float switch assembly as defined in claim 6 wherein said elongate stem is made of non-magnetic material.

9. The refrigerant float switch assembly as defined in claim 6 wherein said elongate stem is made of magnetically attractive material.

10. The refrigerant float switch assembly as defined in claim 5 wherein said tubular member includes a second proximity switch means mounted on said tubular member in spacial relation to and above said first proximity switch means mounted adjacent said base.

11. The refrigerant float switch assembly as defined in claim 5 wherein said tubular member includes a plurality of electrical switch means operatively mounted there adjacent in spacial relation to each other.

12. The refrigerant float switch assembly as defined in claim 6 wherein said float chamber includes biasing means mounted adjacent the top of said float chamber and a connection between said chamber and said tubular member for cushioning said float means as it approaches the top of said float chamber.

* * * * *

UNITED STATES PATENT AND TRADEMARK OFFICE

CERTIFICATE OF CORRECTION

PATENT NO. : 4,647,740

DATED : March 3, 1987

INVENTOR(S) : C. Hansen, et al.

It is certified that error appears in the above-identified patent and that said Letters Patent is hereby corrected as shown below:

At column 7, line 38 and thereafter in claim 1, should read as follows:

said arm and said one side of said switch means body wherein said float chamber includes biasing means mounted adjacent the top of said float chamber which cushions said float means as it approaches the top of said float chamber.

Signed and Sealed this

Eighth Day of September, 1987

*Attest:*

DONALD J. QUIGG

*Attesting Officer*

*Commissioner of Patents and Trademarks*